US005433134A

United States Patent [19]

Leiter

[11] Patent Number: 5,433,134

[45] Date of Patent: Jul. 18, 1995

[54] BLANK FIRING CONVERSIONS FOR SEMIAUTOMATIC PISTOLS

[76] Inventor: Edward J. Leiter, Satis House, Tower Hill Rd., Tuxedo Park, N.Y. 10987

[21] Appl. No.: 132,051

[22] Filed: Oct. 5, 1993

[51] Int. Cl.[6] ..... F41A 21/26

[52] U.S. Cl. ..... 89/14.5; 89/163; 89/196

[58] Field of Search ..... 89/14.5, 163, 196, 162; 42/7

[56] References Cited

U.S. PATENT DOCUMENTS

| | | | |
|---|---|---|---|
| 808,003 | 12/1905 | Browning | 89/163 |
| 863,770 | 8/1907 | Whiting | 89/196 |
| 936,967 | 10/1909 | Whiting | 89/196 |
| 1,168,985 | 1/1916 | Whiting | 42/7 |
| 1,377,629 | 5/1921 | Rosebush | 42/75.03 |
| 1,563,675 | 12/1925 | Tansley | 89/128 |
| 2,872,850 | 2/1959 | Davenport | 89/159 |
| 2,898,693 | 8/1959 | Ruger | 42/77 |
| 3,504,594 | 4/1970 | Greeley | 89/163 |
| 3,724,326 | 4/1973 | Day | 89/196 |
| 3,731,590 | 5/1973 | Zimmerman, Jr. | 89/163 |
| 3,756,120 | 9/1973 | Roy | 89/163 |
| 3,901,125 | 8/1975 | Raville | 89/163 |
| 4,222,308 | 9/1980 | Arnett | 89/163 |
| 4,253,377 | 3/1981 | Arnett | 89/163 |
| 4,580,484 | 4/1986 | Moore | 89/128 |
| 4,854,217 | 8/1989 | Ransom | 89/163 |
| 4,887,510 | 12/1989 | Wynn | 89/163 |
| 4,907,489 | 3/1990 | Teague | 89/14.5 |
| 4,920,676 | 5/1990 | Peters | 42/25 |

FOREIGN PATENT DOCUMENTS

| | | | |
|---|---|---|---|
| 412523 | 7/1910 | France | 89/196 |
| 477693 | 11/1915 | France | 89/196 |
| 319648 | 4/1920 | Germany | 89/196 |
| 20367 | of 1910 | United Kingdom | 89/196 |
| 2163840 | 3/1986 | United Kingdom | 89/14.5 |

*Primary Examiner*—Stephen C. Bentley
*Attorney, Agent, or Firm*—Dilworth & Barrese

[57] ABSTRACT

An automatic pistol for repetitively firing blank ammunition includes a frame, a barrel unit including a barrel chamber portion and a barrel element extending from the barrel chamber portion, and a slide mounted on the frame and reciprocally longitudinally moveable relative to the frame between a forward battery position where the pistol is capable of firing and a rearward position where a spent blank cartridge is ejected. The slide is initially freely moveable relative to the barrel unit to an engaging position of the slide displaced from the forward battery position. At the engaging position, the slide engaes an abutment surface of the barrel unit thereby moving the barrel unit to a position where the barrel chamber portion receives a blank cartridge. A mechanism, e.g., a restrictor element, may be provided for generating sufficient back pressure in the barrel unit upon firing of a blank cartridge to move the slide to the rearward position.

24 Claims, 7 Drawing Sheets

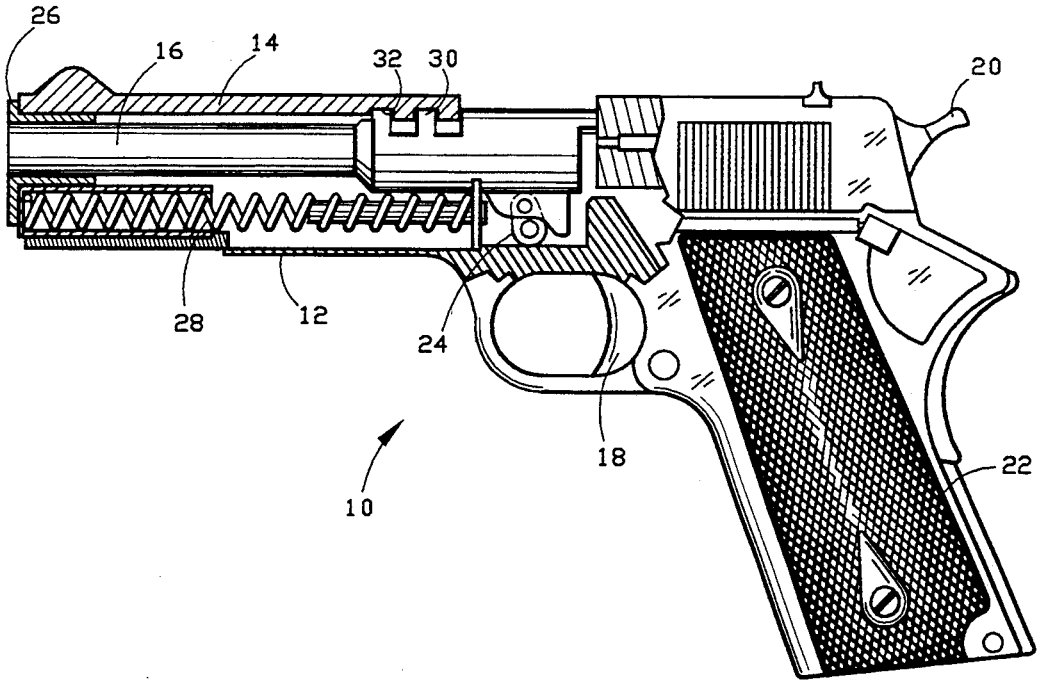
FIG. 1–PRIOR ART
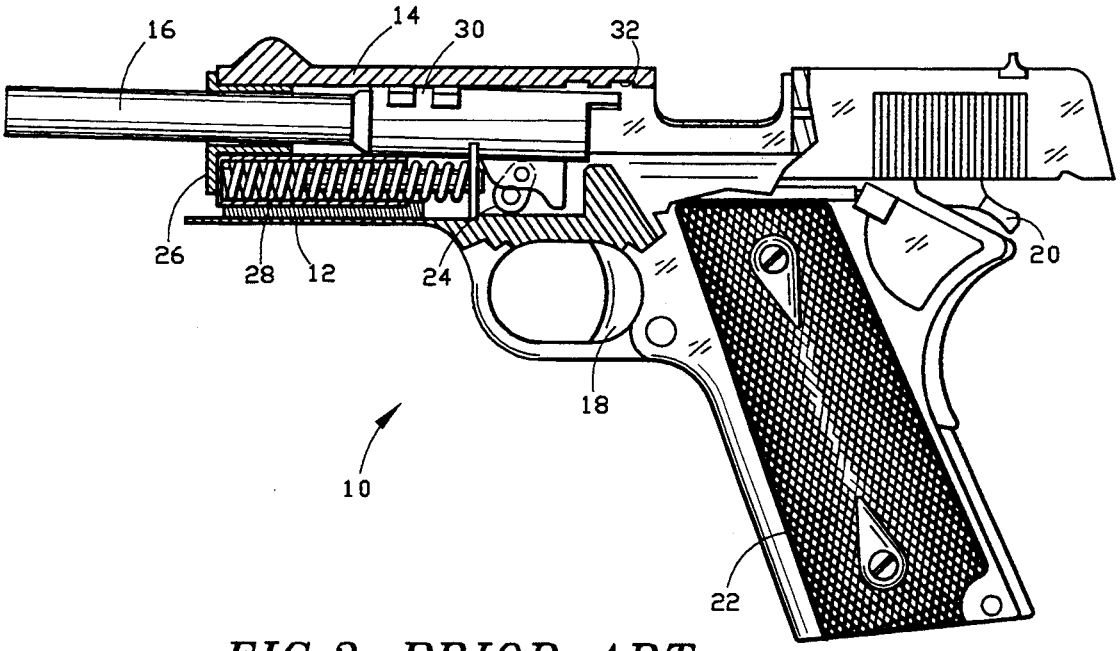
FIG. 2–PRIOR ART

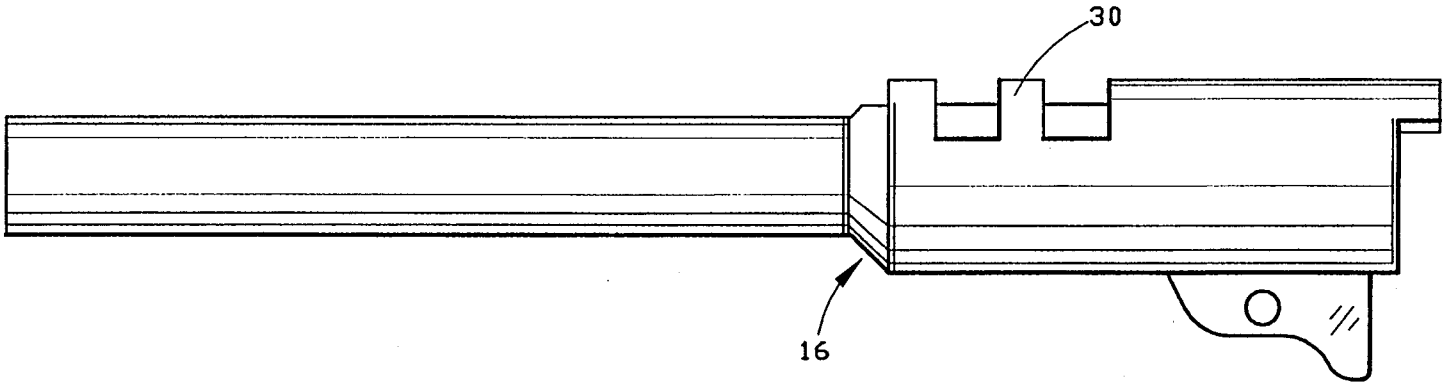
FIG. 5–PRIOR ART
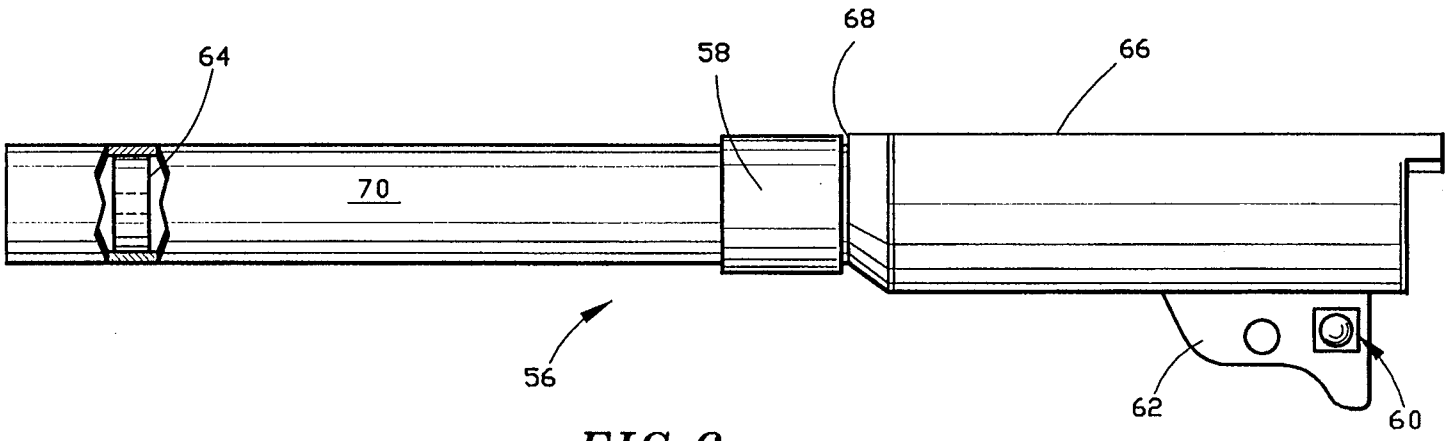
FIG. 6

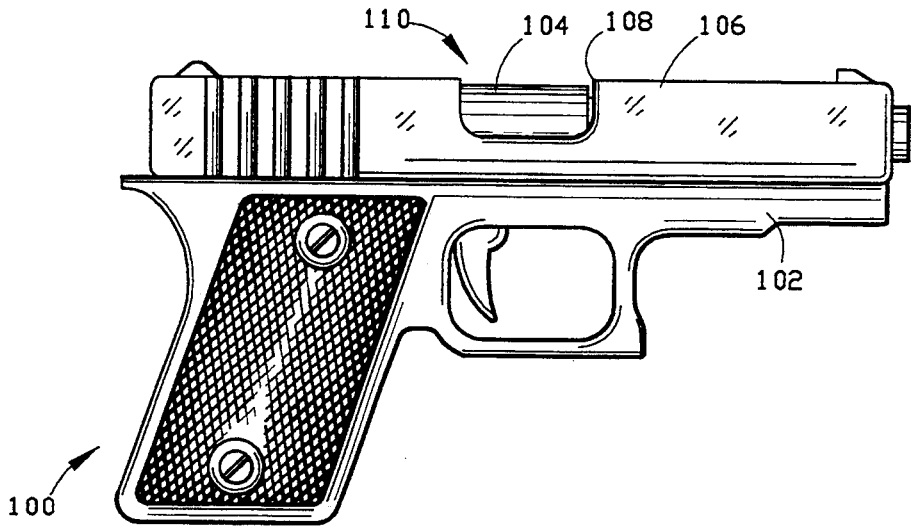
FIG. 9–PRIOR ART
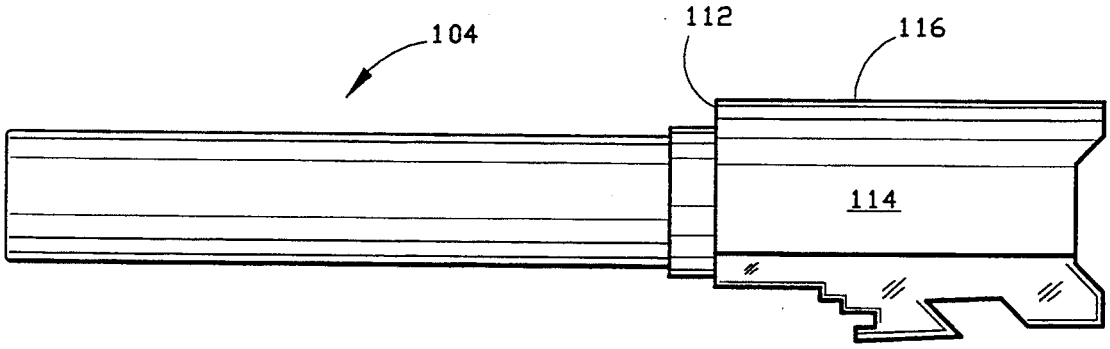
FIG. 10–PRIOR ART

BLANK FIRING CONVERSIONS FOR SEMIAUTOMATIC PISTOLS

BACKGROUND OF THE INVENTION

The present invention relates generally to firearms and, in particular, to modifications made to standard semiautomatic breech-locked, recoil operated firearms for producing reliable, repetitive blank-fire capability in these pistols.

In many conventional semi-automatic weapons, including the Browning and Colt/Browning family of pistols, a breech-lock, recoil activated system is utilized where the barrel and slide are locked together for a predetermined distance in response to firing of a bullet to effect a complete firing cycle, i.e., the opening of the breech after firing a shot, the extraction and ejection of the empty cartridge shell, the cocking of the hammer, the presentation and introduction of a loaded cartridge to the barrel and the closing of the breech are automatically effected through the energy of recoil of the breech closing part. Since by nature breech-locked, recoil activated firearms rely upon the phenomenon of projectile motion within the barrel—which is derived from the projectile mass of the bullet—to create the recoil forces necessary to effect repetitive cycling of the mechanism, blank-fire in this class of firearm will not ordinarily impart the appropriate type or degree of force necessary to effect repetitive cycling of the mechanism. Even with the presence of a bore-restricting element to augment gas pressure and rearward gas thrust against the breech face, the type of force generated is qualitatively different from that evidenced in projectile-motivated live-fire conditions where the projectile's moment of inertia produces recoil characteristics that overcome the breech-locking impediment.

In an effort to overcome the breech-locking impediment so as to fire blank ammunition, the breech locking element in this type of firearm may be eliminated, in effect to create a blowback system of operation devoid of any breech-locking barrel interconnection in an attempt to bypass the problematic absence of forces in projectile-free blank ammunition. However, elimination of the breech-locking features manifests other difficulties in operation of the pistol such as cartridge ejection, cartridge feeding and slide return into battery.

U.S. Pat. No. 4,907,489 to Teague relates to a blank fire configuration for a recoil operated automatic pistol for converting a standard live-fire pistol to a blank-firing pistol. In accordance with the Teague '489 device, the live-fire barrel of the pistol is replaced with a modified short barrel to which an inner sleeve is threadably attached. An outer sleeve is also provided to receive the inner sleeve in a telescopic arrangement. A barrel anchor is secured to the pistol frame and a spring retention rod projects from the barrel anchor to receive a shortened recoil spring.

The aforementioned Teague '489 device is subject to several disadvantages which limit its usefulness. Most significant of these disadvantages is that the Teaque '489 device results in an obvious alteration in the outward appearance of the firearm, by the creation of an uncharacteristic muzzle signature and the corruption of manifest design elements by the introduction of components not indigenous to the design of live-fire automatic pistols.

Accordingly, the present invention is directed to a superior, highly efficient, comparatively simple, cost effect pistol adaptation which produces reliable, repetitive blank-fire capability. While incorporating a bore-occluding restrictor of appropriate geometries to generate back pressure within the firearm in a manner well known in the art, the novel elements of blank-fire modification of the present invention accomplish highly reliable, repetitive operation without visible alteration to the firearm, thus importing an exceptional degree of verisimilitude.

SUMMARY OF THE INVENTION

The present invention is directed to an automatic pistol adapted to fire blank ammunition. The pistol comprises a frame and a slide mounted on the frame and adapted for reciprocal longitudinal movement between first and second positions. The first position of the slide corresponds to a firing position wherein the pistol is capable of firing which thereby drives the slide to the second position wherein a spent blank cartridge is ejected. The pistol further includes a modified barrel unit including a barrel chamber portion and a generally cylindrically shaped barrel element extending from the barrel chamber portion. A restrictor element is secured within a forward portion of the barrel element and defines a constricted opening dimensioned and configured to generate sufficient back pressure in the barrel unit upon firing of a blank cartridge to move the slide to the second position. Means is provided and associated with the slide for engaging the barrel unit upon movement of the slide through a predetermined distance such that the slide generates sufficient momentum to move the barrel unit rearwardly to a position wherein a blank cartridge is loaded within the barrel chamber portion of the barrel unit. The preferred engaging means may be in the form of an abutment surface formed at the juncture of the barrel chamber portion and barrel element of the barrel unit and an engaging surface of the slide, whereby the engaging surface of the slide is correspondingly configured and dimensioned to engage the abutment surface of the barrel unit to thereby drive the barrel unit to move the barrel unit rearwardly to load a blank cartridge. Recoil spring means operatively connected to the slide returns the slide to the first position thereof.

In an alternative preferred embodiment, the automatic pistol adapted to fire blank ammunition comprises a frame and a slide mounted on the frame and adapted for reciprocal longitudinal movement between a forwardmost position and a rearmost position. When the slide is in the forwardmost position the pistol is capable of firing so as to move the slide to the rearmost position to eject a spent cartridge and receive a live blank cartridge. A slide bushing is mounted to a forward end portion of the slide. A modified barrel is incorporated in the pistol and includes a barrel chamber portion defining a substantially planar upper surface, a barrel element extending distally from the barrel chamber portion and defining a forward end portion which is received within the slide bushing and a barrel linkage housing extending downwardly from the barrel chamber portion. The modified barrel is connected to the frame by a pivotal connecting link connected to the barrel linkage housing. A restrictor plug is positioned within the forward end portion of the barrel element and defines a restricted orifice dimensioned to increase back pressure upon firing of the blank to provide sufficient force to drive the slide to the rearmost position thereof. A barrel bushing is securely attached about the barrel element at a position adjacent the barrel chamber portion and is dimensioned and configured to engage the slide bushing as the slide moves to its rearward position to thereby move the barrel unit rearwardly to a first position where the barrel chamber portion receives a live blank cartridge. A mechanical impediment or spring detent means is disposed between the barrel linkage housing and the frame and is dimensioned and configured to retain the barrel unit for a predetermined time period in the first position to receive a live cartridge. Recoil spring means is provided to move the slide to the forwardmost position thereof after loading of the live blank cartridge, wherein as the slide moves to the forward most position the barrel unit moves forwardly to a second position whereby the pistol is capable of firing.

In another alternative embodiment, the automatic pistol for firing blank ammunition includes a frame, a slide reciprocally mounted on the frame between a forwardmost position and a rearmost position, wherein when the slide is in the forwardmost position the pistol is capable of firing so as to move the slide to the rearmost position to eject a spent cartridge and receive a live cartridge. The slide also includes a slide ejection port area defining a vertical abutment surface. A modified barrel unit is incorporated in this pistol and includes a barrel chamber portion and a barrel element extending from the barrel chamber portion. The juncture of the barrel chamber portion and the barrel element defines an abutting surface engageable with the slide as the slide moves towards its rearmost position. The abutting surface is offset at an angle relative to a longitudinal axis of the barrel element and is configured and dimensioned to engage the slide after the slide moves rearwardly a predetermined distance so that the slide generates sufficient momentum to move the barrel unit rearwardly to a position wherein a blank cartridge is loaded within the barrel chamber portion of the barrel unit. At the same time, the barrel chamber abutting surface incorporates a planar longitudinal area which limits upward and forward barrel motion in the slide element to maintain proper cartridge feeding position of the barrel unit during the recoil cycle.

BRIEF DESCRIPTION OF THE DRAWINGS

Preferred embodiments of the invention are described hereinbelow with reference to the drawings wherein:

FIG. 1 is a side elevational view in partial cross-section of a semiautomatic Colt/Browning-derivative pistol to be modified in accordance with the principles of the present invention depicted prior to modification and firing of the pistol;

FIG. 2 is a side elevational view in partial cross-section of the firearm of FIG. 1, illustrating the positioning of the operating components after firing of the pistol;

FIG. 5 is an enlarged side elevational view of the barrel of the pistol of FIG. 1 prior to modifying same in accordance with the principles of the present invention;

FIG. 6 is an enlarged side elevational view of the modified barrel of the pistol of FIGS. 3 and 4 modified in accordance with the principles of the present invention;

FIG. 9 is a side elevational view of a Glock/Sig-Sauer Type derivative pistol to be modified in accordance with the principles of the present invention depicted prior to modification and firing of the pistol;

FIG. 10 is an enlarged side elevational view of the barrel of the Glock/Sig-Sauer Type pistol of FIG. 9 prior to modifying same in accordance with the principles of the present invention;

FIG. 12 is an enlarged side elevational view of the modified barrel of the pistol of FIG. 11 modified in accordance with the principles of the present invention; and.

DETAILED DESCRIPTION OF THE PREFERRED EMBODIMENTS

Figure 3:
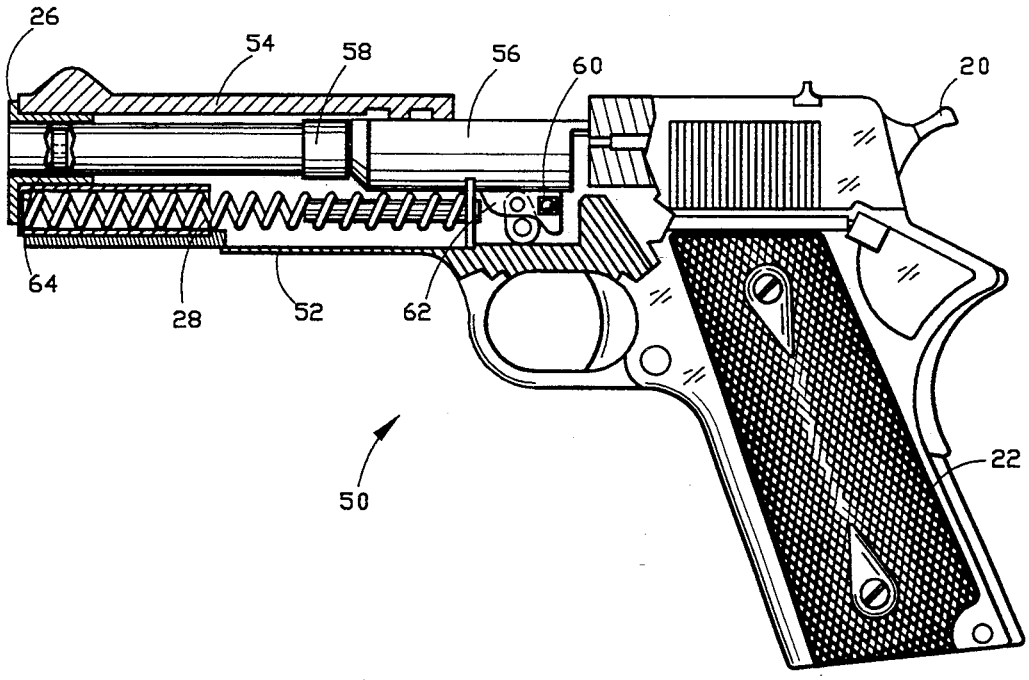
FIG. 3 is a side elevational view in partial cross-section of the pistol of FIG. 1 modified in accordance with the principles of the present invention to fire blank ammunition in an automatic repetitive manner with the pistol being depicted prior to firing.

Referring initially to FIGS. 1 and 2, there is illustrated a standard Browning design, Colt M1911/45 ACP firearm which may be modified to fire blank ammunition in accordance with the principles of the present. Generally, pistol 10 includes three principal components, namely, frame 12, slide 14 mounted on frame 12 and barrel 16. Frame 12 includes trigger meachanism 18 having hammer 20 and handle or grip portion 22.

Slide 14 is mounted on frame 12 and is adapted for reciprocal longitudinal movement on the frame in response to firing of the pistol. Barrel 16 is slidable and tiltable relative to slide 14 and is operatively connected to frame 12 through linkage meachanism 24. The forward end of slide 14 is provided with slide bushing 26 which is positioned over the muzzle of barrel 16 to support the forward end of the barrel during operation of the pistol. Pistol 10 also includes a recoil spring mechanism identified generally as reference numeral 28 positioned below barrel 16 to return slide 14 to the forward battery position after recoil. A breech lock mechanism in the form of locking ribs 30 provided on the top of barrel 16 and correspondingly dimensioned recesses 32 formed in the upper surface of slide 14, as in conventional pistols of this type, is also provided. Recesses 32 receive ribs 30 to securely interlock the slide 14 and the barrel 16 when the pistol is in the forward battery position of FIG. 1.

Upon firing a live cartridge with projectile element, the recoil action of the bullet forces slide 14 rearwardly and, due to its interconnection with the barrel 16, barrel 16 moves rearwardly. As barrel 16 moves rearwardly, linkage mechanism 24 connected to the rear under portion of the barrel 16 and the frame 12 causes simultaneous downward movement of the barrel, thus effecting release of the breech locking mechanism, i.e., the locking ribs 30 become disengaged from recesses 32. In consequence of this downward substantially arcuate motion of barrel 16, the cartridge case, while still contained within the firing chamber of barrel 16 is drawn downwardly along the breech face of slide 14, and is subsequently extracted from the chamber after barrel motion is arrested—so to be expelled positively from the weapon by an ejector element (not shown). A subsequent cartridge in the magazine (not shown) is fed into the firing chamber to permit continued successive firing of subsequent cartridges. Recoil spring mechanism 28 then drives slide 14 to the forward battery position in a conventional manner. FIG. 2 illustrates the movement of slide 14 and barrel 16 after firing of the pistol 10.

Figure 4:
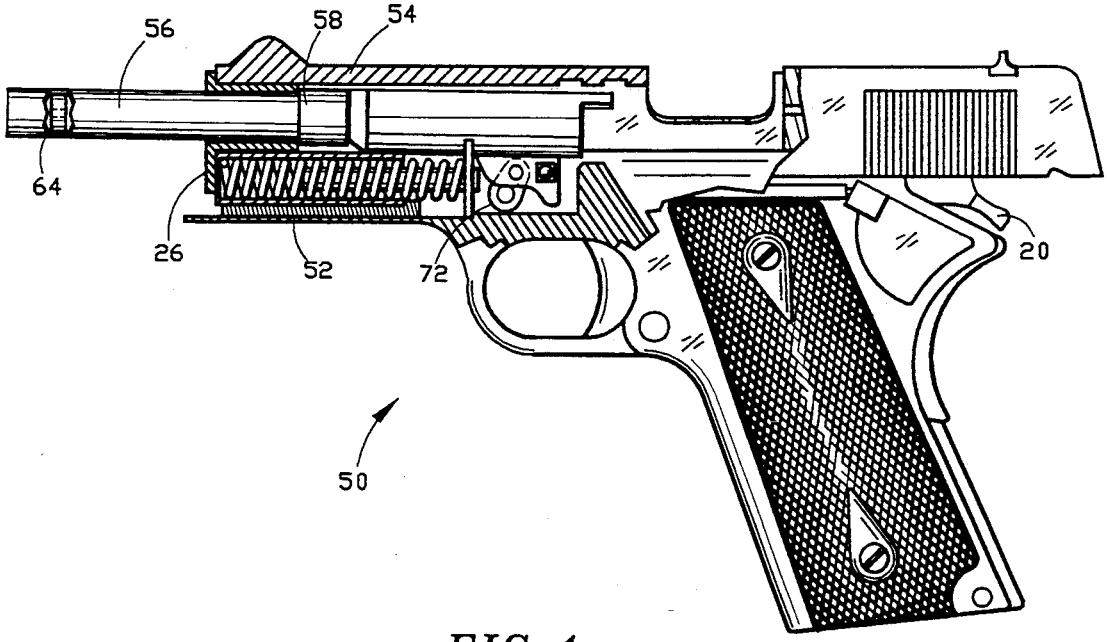
FIG. 4 is a side elevational view of the modified pistol for firing blank ammunition of FIG. 3 subsequent to firing of the pistol.

Referring now to FIGS. 3–4, there is illustrated the novel blank-fire semiautomatic pistol constructed in accordance with the principles of the present invention. FIG. 3 is a side elevational view of the blank firing pistol in a forward battery position. FIG. 4 is a similar view depicting the modified pistol in a rearward position after firing. As shown in FIGS. 3–4, modified pistol 50 incorporates the three basic components present in the pistol of FIGS. 1 and 2, namely, frame 52, slide 54 mounted on frame 52 and adapted for reciprocal longitudinal movement relative to the frame and modified barrel 56. Pistol 50 also includes barrel bushing 58, a spring loaded detent mechanism 60 adjacent linkage housing 62 of barrel 56 and a bore restricting element 64 positioned within the forward end portion of the modified barrel 56. The features and significance of bushing 58 and detent mechanism 60 will be discussed in greater detail below.

Bore restricting element 64 serves in increasing the back-pressure of propellant gases to facilitate firing of the blank ammunition and may be of conventional type. One suitable bore restricting element to increase such back pressure is disclosed in U.S. Pat. No. 5,140,893 to Leiter, the contents of which are incorporated herein by reference. The blank firing adapter disclosed in Leiter '893 includes a propellant gas-occluding passage which terminates in a conical zone defined upon the rear surface of the adapter. The length of the gas-occluding passage of the Leiter '893 device is less than the diameter of the adapter.

Referring now to FIGS. 5 and 6, the modified barrel 56 of pistol 50 for firing blank ammunition will be described in detail. FIG. 5 illustrates a conventional barrel for firing live ammunition such as the barrel incorporated in the pistol of FIGS. 1 and 2. FIG. 6 illustrates the barrel 56 modified in accordance with the present invention and which is a component of the pistol of FIGS. 3 and 4. As shown in FIG. 6, modified barrel 56 includes a substantially planar barrel hood area 66, in which the barrel locking ribs have been removed (compare FIG. 5), to bypass the mechanical impediment of the breech locking mechanism, to account thereby for the absence of force of projectile free blank ammunition. Such removal of the breech locking mechanism converts the pistol 50 from breech locked operation to a blowback function. An abutment shoulder 68 is defined at the intersection of the forward end portion of the planar hood area 66, and barrel element 70, the importance of which shoulder 68 will become apparent from the description provided below.

Referring now to FIGS. 3 and 4, in conjunction with FIG. 6, the features of bushing 58 will be described in detail. Bushing 58 is positioned forward of the chamber swell area as shown and is appropriately dimensioned to impinge upon original slide bushing component 26 as slide 54 moves rearwardly in response to firing of the pistol, thereby driving barrel 56 rearwardly and downwardly via linkage mechanism 72 to its appropriate position to extract a spent cartridge and receive a live cartridge from the magazine. Bushing 58 is appropriately dimensioned to permit unrestricted rearward movement of slide 54 for a predetermined distance after firing without engagement of slide bushing 26 with barrel bushing 58 such that slide 54 generates adequate momentum to drive the barrel 56 rearwardly once the slide bushing 26 contacts the bushing 58. One skilled in the art may readily determine the appropriate dimension of barrel bushing 58 to achieve this objective. Bushing 58 may be a permanently positioned and fixed element of barrel unit 56 and may be integrally incorporated into barrel 56 during manufacturing or laterally secured by appropriate methods such as by brazing or welding.

Figure 7:
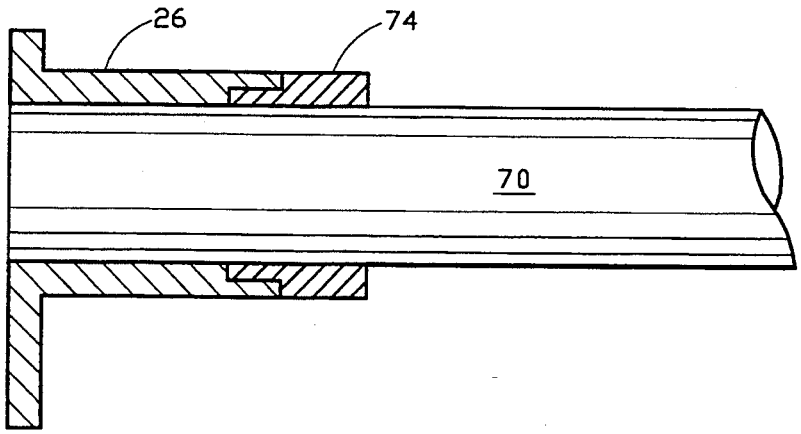
FIG. 7 is a partial enlarged sectional view of the forward end portion of an alternative embodiment of the modified barrel of FIG. 6 with a bushing insert positioned within the original slide bushing.

In an alternative embodiment shown in FIG. 7, the above-described rearward movement of barrel 56 may be achieved by positioning an extended bushing insert 74 within the original slide bushing 26 about the forward end of barrel element 70 and securing the insert 74, by appropriate means such as soldering or welding, to the slide bushing 26. Such effective rearward extension of bushing 26 may be accomplished integrally during original manufacture of bushing element 26. Bushing insert 74 is strategically dimensioned to extend beyond the rear end portion of original slide bushing 26 so as to engage abutment shoulder 68 (FIG. 6) of modified barrel 56 during the recoil stage of operation to drive barrel 56 rearward and downwardly via linkage 72 to effect appropriate positioning of the barrel to eject the expended cartridge case. It is to be appreciated that bushing insert 74 is also appropriately dimensioned to permit unrestricted movement of slide 54 for a predetermined distance without engaging abutment shoulder 68 of barrel 56 so as to generate adequate momentum to move the barrel rearwardly once the insert contacts the shoulder 68. One skilled in the art may readily determined the appropriate dimensioning of bushing insert 74 to effect such action.

Referring now to FIGS. 3 and 4, in conjunction with the cross-sectional view of FIG. 8, the function and position of the spring loaded detent mechanism 60 will be described. As previously addressed, under live fire conditions barrel 56 is driven rerarwardly and downwardly into ejection/feeding position. In the unmodified conventional pistol of FIGS. 1 and 2, the presence of linkage mechanism 24, together with the contact presented by barrel locking ribs 30 upon the underside of the fully retracted slide 14 in its normal recoil position, positively prevents the barrel 56 from becoming dislodged in the forward direction from its rearward contact with the frame feeding ramp (not shown) under the forward thrust of a subsequent cartridge as the cartridge strikes the chamber area during loading of the cartridge. However, since in the modified barrel of FIGS. 3, 4 and 6 of the present invention the contact between the barrel and slide underside has been eliminated, the normal motion and thrust of subsequent blank cartridges into the barrel chamber from the magazine would cause barrel 56 to be driven forward, out of contact with the frame feeding ramp, (not shown) thus causing a failure to chamber or a jamming action. Accordingly, in order to correct for the absence of barrel/slide interconnection during discharge of blank ammunition, a mechanical impediment in the form of a spring-loaded ball detent mechanism 60 is incorporated to replace the function of barrel rib/slide underside contact until a cartridge has been successfully chambered.

Figure 8:
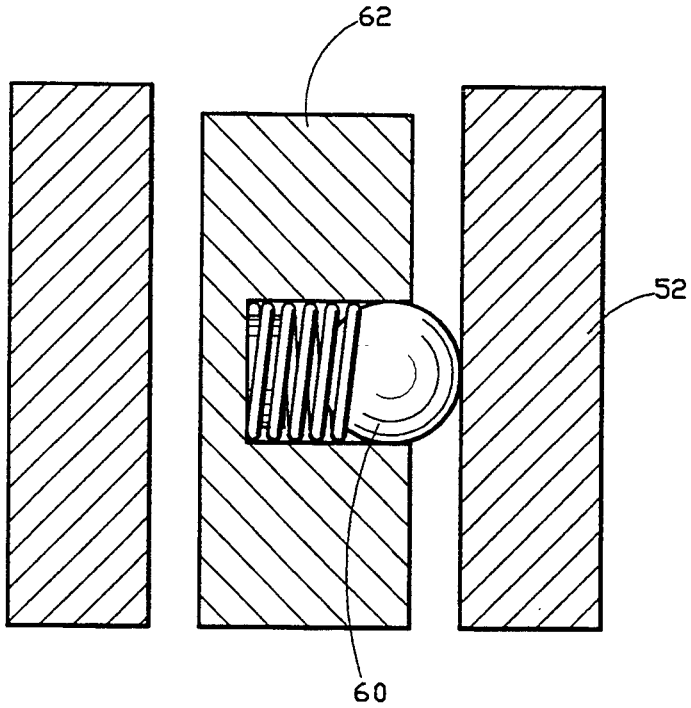
FIG. 8 is a partial fragmentary sectional view of the spring ball detent mechanism of the modified pistol of FIGS. 3 and 4.

Referring particularly to FIGS. 3, 6 and 8 the detent mechanism 60 is disposed at the side of the linkage housing 72 beneath the barrel 50 exerts an outward force against the inner surface of frame 52. The geometries of the ball detent mechanism are made to correspond with the geometries of the barrel linkage housing 72, frame 52, requisite frictional force to overcome the thrust of the momentum of blank ammunition being funneled into the chamber and the necessity that such frictional force exerted by the detent 60 against the frame 52 be less than the force generated by the momentum of the slide as it strikes the rear end of the barrel during the return to battery phase. One skilled in the art may readily determine the appropriate geometries of ball-detent mechanism to accomplish this objective.

Referring now to FIGS. 3, 4 and 6, the outer diameter of the barrel 50 from the forward end portion of barrel element 70 to the point of chamber swell may be generally reduced in dimension so as to reduce the angle through which the barrel 56 must traverse in its forward motion to realign with slide 52 during return to battery. Similarly, the opening of slide bushing 26 and insert 74 may be increased appropriately to permit realignment of barrel 56 during such return to battery cycle. One skilled in the art may readily determine the appropriate dimensioning to effect such movement.

Thus, in accordance with the present invention, blank-firing modification of recoil-operated, breech-locked semiautomatic pistols, such as a Browning or Colt/Browning derivative firearm, is accomplished by bypassing the mechanical impediment of the breech-locking provision while still effecting rearward barrel tilt for proper positioning of the barrel via barrel bushing 58 or bushing insert 74 (FIG. 7) to expend a cartridge case. The barrel is retained in its rearmost position for the proper duration to permit normal feeding of successive rounds of ammunition into the firing chamber of the barrel 56 by spring ball detent mechanism 60. Thereafter, barrel 56 and slide 54 are returned to components battery for continued and successive firing of the subsequent blank cartridges.

Referring now to FIGS. 9 and 10 there is illustrated a Glock 17/Sig-Sauer P226 derivative firearm to be modified in accordance with the principles of the present invention. FIG. 9 is a side elevational view of an unmodified conventional Glock-type pistol. FIG. 10 is a side elevational view of the barrel unit of the conventional Clock pistol. Pistol 100 is of conventional type and also incorporates a recoil/breech lock system to operate in a repetitive mode. Pistol 100 includes frame 102, barrel 104 and slide 106 slidably mounted on the frame as is conventional with this pistol design. A breech lock mechanism in the form of a vertical abutment surface 108 of the slide ejection port area 110 engages a vertical abutting surface 112 adjacent barrel chamber 114 to drive barrel 104 rearwardly to its appropriate position during recoil. A recoil spring mechanism (not shown) returns barrel 104 to its forward battery position.

In this design class, no fixed linkage connection exists between the barrel 104 and frame 106, which linkage would limit the upward travel of the barrel 104 within the reciprocating slide 106. However, the upper hood surface 116 of the barrel chamber area 114 maintains a planar contacting surface above the level of the bore and against the underside of reciprocating slide 106 to limit this upward barrel motion within the recoiling slide, thus preventing the barrel 104 from rising upward or forward out of its rearmost frame contact during the case ejection and cartridge-feeding position. In this sense, barrel 104 may be said to "free-float" between frame 102 and slide 106, while its limit of upward and forward movement is contained and determined by the geometries of the component elements of barrel hood 116 and slide underside.

Figure 11:
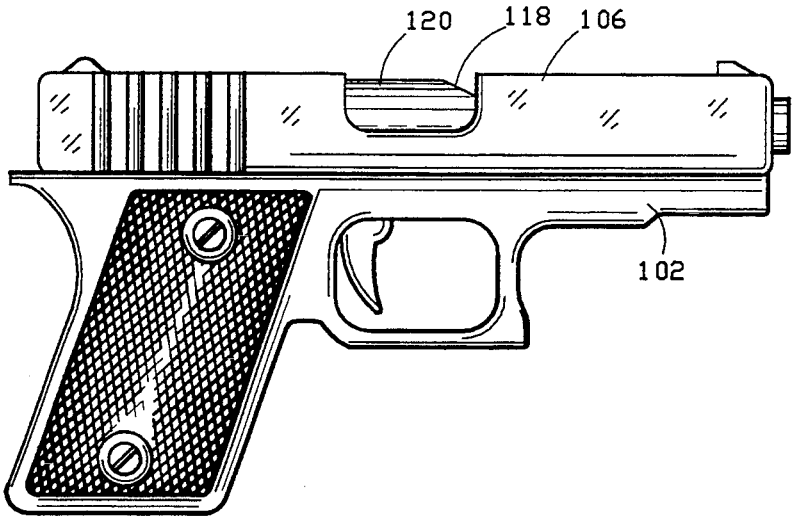
FIG. 11 is a side elevational view of the Glock/Sig-Sauer Type derivative pistol of FIG. 9 modified to fire blank ammunition in accordance with the principles of the present invention.
Figure 12:
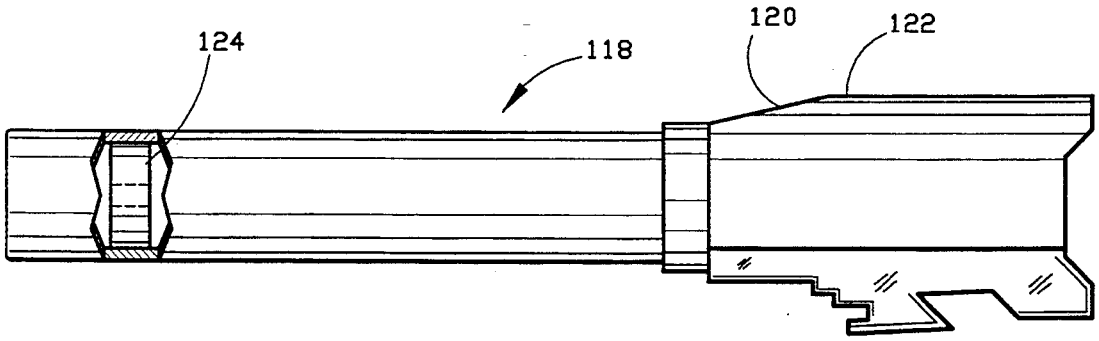

Referring now to FIGS. 11 and 12 the novel modified blank firing pistol of the Glock 17/Sig-Sauer P226 derivative class, depicted in FIGS. 9 and 10, as modified in accordance with the principles of the present invention is illustrated. FIG. 11 is a side elevational view of the modified pistol. FIG. 12 is a side elevational view of the modified barrel 118 incorporated in the pistol of FIG. 11. As shown, the breech locking mechanism which was created between vertical abutment surface 108 and vertical abutting surface 112 has been modified to create a modified blowback system. This alteration is accomplished by modifying the abutting surface 120 of the barrel hood area 122 such that a rearwardly inclined plane of between 8 and 15 degrees, more preferred between 10 and 13 degrees relative to the longitudinal axis defined by the bore of the barrel is created as shown. The remaining portion of the barrel hood surface 122 remains unaltered. A restrictor plug 124 is secured within the forward end portion of barrel 118 and functions in a similar manner to the restrictor plug 64 of the embodiment of FIGS. 3 and 4, i.e., to increase the back pressure of propellant gases to facilitate firing of blank ammunition.

The modification to the barrel hood area thus created diminishes the effect of initial barrel/slide locking by allowing a measured or predetermined distance of free-travel of slide 106 to the rear under recoil, thus creating a delay between the slide's rearward movement and its contact with the altered barrel hood incline 120 of the barrel. Consequently, this delay, in concert with the critical angle of the barrel hood incline 120, permits slide 106 to achieve sufficient unimpeded rearward velocity and acquired momentum during the initial stages of the recoil, so that the slide 106 impinges upon the barrel incline 120, driving the barrel 118 rearwardly into cartridge ejection and feeding position, and, simultaneously retaining the barrel hood surface 122 from upward and forward motion limitation within the slide, thus having fixed the rearward orientation of the barrel 118 upon the frame 102 for the purpose of case ejection and subsequent cartridge feeding as the slide reaches and begins its return from full-recoil position. Furthermore, the nature of the critical barrel incline 120 angle permits adequate time for the slide to impart this rearward thrust to the barrel 118 from its forward, in-battery position, without effecting the interference or barrel/slide locking phenomenon normally associated with barrel/slide contact in breech-locked firearm mechanisms.

Modified barrel 118 is retained in the rearward feeding position in order to receive blank ammunition being fed from the magazine in a conventional manner. In particular since the rear end portion of the barrel hood surface 122 is unaltered, contact between the underside of the recoiling slide 106 and the upper barrel positioning flat has been retained. Therefore, the barrel 118 will remain in its rearward feeding position and will accomplish chambering of subsequent blank ammunition, after which the barrel 118 will be driven forward into battery by the normal forward thrust and momentum imparted by the forward motion of slide 106. It is to be appreciated that the outer diameter of barrel 118 may be reduced, by, for example, 0.015 inches to facilitate proper return of barrel 104 to battery as described in connection with the embodiment of FIGS. 3 and 4.

Figure 13:
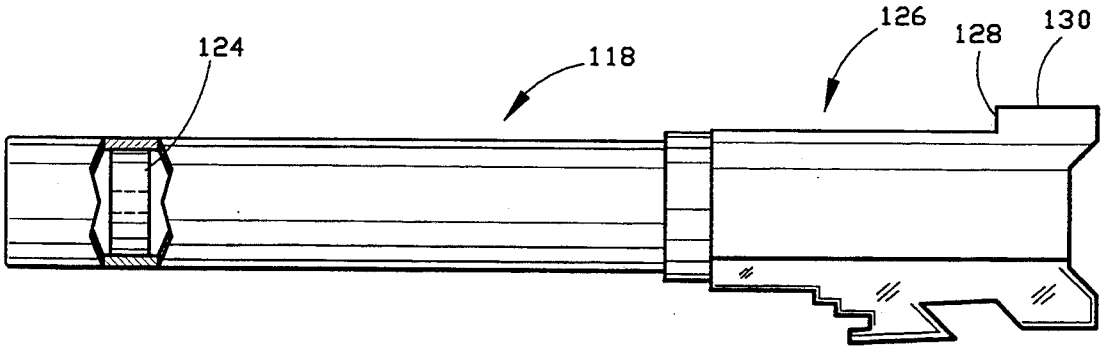
FIG. 13 is a side elevational view of an alternative embodiment of the modified barrel of the present invention to be incorporated in the pistol of FIG. 11.

In an alternative embodiment shown in FIG. 13, the barrel hood area 126 may be modified by a grinding operation or the like to define an abutting surface 128 at a position rearward of the vertical abutting surface 112 of the conventional pistol 100 depicted in FIGS. 9 and 10. By displacing the abutting surface 128 a predetermined distance from the forward end portion of barrel hood area 126, slide 106 is permitted to move rearwardly a substantial distance before contacting abutting surface 128, thereby enabling the slide to achieve an increased rearward velocity and momentum to drive the barrel rearwardly into appropriate cartridge ejection and feeding position. Abutting surface 128 may be a vertical surface, i.e., at an angle of 90 degrees relative to the longitudinal axis of the barrel bore as shown in FIG. 13. It is also to be appreciated that abutting surface 128 may assume other angular orientations to achieve the intended purpose of being engaging by slide 106 so as to drive the barrel to the cartridge feeding and ejecting position. One skilled in the art may readily determine the appropriate positioning and orientation of abutting surface 128 to achieve this objective. The barrel will remain in its rearward position to accomplish chambering of a subsequent blank cartridge by the contact between the unaltered rear end portion of the barrel hood surface 130 and the underside of recoiling slide 106.

It is to be noted that while two representatives classes of recoiloperated, breech locked firearms are used for examples, the embodiments put forth apply equally to firearms possessing similar design elements, and include, though are not necessarily limited to the Ruger P85/P89/P90, the Smith & Wesson 39/59/5900/6900-Series, Browning and Colt/Browning-derivative firearms, as well as other recoil-operated, breech-locked pistols possessing a barrel/slide-mated locking surface provision, and chambered in, but not limited to, calibers 9 mm Parabellum, 0.45ACP, 0.40 S & W, 10 mm, 9 mm Winchester Magnum, 0.45 Winchester Magnum, 0.30M Carbine, or other calibers utilized in recoil-operated, breech-locked firing mechanisms.

It will be understood that various modifications can be made to the embodiments of the present invention herein disclosed without departing from the spirit thereof. The above description should not be construed as limiting the invention but merely as exemplifications of preferred embodiments thereof. Those skilled in the art will envision other modifications within the scope and spirit of the present invention as defined by the claims appended hereto.

What is claimed is:

1. An automatic blank-firing pistol adapted to fire blank ammunition, which comprises:

a frame, a barrel unit including a barrel chamber portion and a barrel element extending from said barrel chamber portion, the juncture of said barrel chamber portion and said barrel element defining an abutment surface, said abutment surface being oriented at an oblique angle relative to a longitudinal axis defined by said barrel element;

a slide mounted on said frame and adapted for reciprocal longitudinal movement relative to said frame between a forward battery position and a rearward position, said slide engaging said abutment surface of said barrel unit at a position rearwardly displaced from said forward battery position during rearward movement of said slide to drive said barrel unit rearwardly to a position where said barrel chamber portion receives a blank cartridge; and a restrictor member associated with the said barrel element and being dimensioned and configured to generate sufficient back pressure in said barrel unit upon firing of a blank cartridge to move said slide to said rearward position.

2. The automatic pistol of claim 1 wherein the angle of said abutment surface ranges from about 8° to about 15° relative to said longitudinal axis of said barrel element.

3. The automatic pistol of claim 1 further comprising recoil spring means to move said slide to said forward battery position wherein as said slide moves to said forward battery position said barrel unit moves forwardly to a firing position thereof wherein the pistol is capable of firing.

4. The automatic pistol of claim 1 wherein the the angle of said abutment surface relative to said longitudinal axis is less than about 30° C.

5. In an automatic pistol adapted to fire blank ammunition, the pistol including a frame, a slide reciprocally mounted on said frame between a forwardmost position and a rearmost position, wherein when said slide is in forwardmost position the pistol is capable of firing so as to move said slide to said rearmost position to eject a spent cartridge, said pistol including:

a modified barrel unit including a barrel chamber portion and a barrel element extending from said barrel chamber portion, wherein the juncture of said barrel chamber portion and said barrel element defines and abutting surface, said abutting surface offset at an oblique angle relative to a longitudinal axis of said barrel element and configured and dimensioned to be engaged by an abutment surface of said slide upon rearward movement of said slide to a position displaced from said forwardmost position such that said slide generates sufficient momentum to move said barrel unit rearwardly to a position of said barrel unit wherein a blank cartridge is loaded within said barrel chamber portion.

6. The automatic piston of claim 5 wherein said abutting surface of said barrel unit is angularly offset at an angle ranging from about 8° to about 15° relative to said longitudinal axis of said barrel element.

7. An automatic pistol adapted to fire blank ammunition which comprises:

a frame;

a barrel unit including a barrel chamber portion and a barrel element extending from said barrel chamber portion, said barrel element defining a longitudinal axis, said barrel unit defining and abutment surface oriented at an angle relative to said longitudinal axis;

a slide mounted on said frame and reciprocally longitudinally moveable relative to said frame between a forward battery position and a rearward position, said slide including a slide ejection port area defining a forward engaging surface, said slide initially freely rearwardly moveable relative to said barrel unit to an engaging position of said slide, said engaging position being rearwardly displaced from said forward battery position, wherein, at said engaging position, said forward engaging surface of said slide engages said abutment surface of said barrel unit thereby moving said barrel unit rearwardly to a position wherein said barrel chamber portion receives a blank cartridge; and means associated with said barrel unit for generating sufficient back pressure in said barrel unit upon firing of a blank cartridge to move said slide to said rearward position.

8. The automatic pistol of claim 7 wherein said barrel chamber portion includes a forward and a rear end and wherein said abutment surface is disposed at a position intermediate said forward and rear ends of said barrel chamber portion.

9. The automatic pistol of claim 8 wherein said abutment surface is substantially transverse to said longitudinal axis of said barrel element.

10. The automatic pistol of claim 7 wherein said means associated with said barrel unit for generating sufficient back pressure includes a restrictor plug positioned within said barrel element and defining a restricted orifice.

11. The automatic pistol of claim 7 further including recoil spring means to move said slide to said forward battery position wherein as said slide moves to said forward battery position said barrel unit moves forwardly to a firing position thereof wherein the pistol is capable of firing.

12. The automatic pistol of claim 11 wherein said barrel unit is engageable with said slide such that as said slide moves forwardly from said rearmost position said barrel unit is moved forwardly to said firing position thereof.

13. The automatic pistol of claim 7 wherein said barrel chamber portion of said barrel unit is adapted to move downwardly to said position where said barrel chamber portion receives the blank cartridge.

14. The automatic pistol of claim 7 wherein said abutment surface of said barrel unit is oriented at an oblique angle relative to said longitudinal axis.

15. The automatic pistol of claim 14 wherein the angle of said abutment surface relative to said longitudinal axis is less then about 30°.

16. The automatic pistol of claim 15 wherein said abutment surface of said barrel unit is defined at the juncture of said barrel element and said barrel chamber portion.

17. An automatic pistol adapted to fire blank ammunition which comprises:

a frame;

a barrel unit including a barrel chamber portion and a barrel element extending from said barrel chamber portion, said barrel element defining a longitudinal axis, said barrel unit defining abutment surface oriented at an oblique angle relative to said longitudinal axis;

a slide mounted on said frame and reciprocally longitudinally moveable relative to said frame between a forward battery position and a rearward position, said slide initially freely rearwardly moveable relative to said barrel unit to an engaging position of said slide, said engaging position being rearwardly displaced from said forward battery position, wherein at said engaging position, an engaging surface of said slide engages said abutment surface of said barrel unit thereby moving said barrel unit to a position where said barrel chamber portion receives a blank cartridge; and means associated with said barrel unit for generating sufficient back pressure in said barrel unit upon firing of a blank cartridge to move said slide to said rearward position.

18. The automatic pistol of claim 17 wherein said abutment surface is defined at the juncture of said barrel chamber portion and said barrel element.

19. The automatic pistol of claim 18 wherein said abutment surface defines an angle ranging from about 8° to about 15° relative to said longitudinal axis of said barrel element.

20. The automatic pistol of claim 17 wherein said barrel chamber portion defines an upper contacting surface, said contacting surface engageable with an undersurface of said slide when said barrel unit is in said position where said barrel chamber portion receives a blank cartridge such that said barrel unit is retained in said position for a sufficient period of time to permit feeding of the blank cartridge in said barrel chamber portion.

21. In an automatic pistol adapted to fire blank ammunition, the pistol including a frame, a slide reciprocally mounted on said frame between a forwardmost position and a rearmost position, wherein when said slide is in said forwardmost position the pistol is capable of firing so as to move said slide to said rearmost position to eject a spent cartridge, said pistol including:

a modified barrel unit including a barrel chamber portion for receiving a blank cartridge and a barrel element extending from said barrel chamber portion, said barrel chamber portion including a forward end and rear end and defining a vertical abutting surface disposed at a position intermediate said forward and rear ends of said barrel chamber portion, said abutting surface configured and dimensioned to be engaged by said slide upon rearward movement of said slide to a position displaced from said forwardmost position such that said slide generates sufficient momentum to move said barrel unit rearwardly to a position of said barrel unit wherein said barrel chamber portion receives a blank cartridge.

22. The automatic pistol of claim 21 further including recoil spring means to move said slide to said forward battery position wherein as said moves to said forward battery position said barrel unit moves forwardly to a firing position thereof wherein the pistol is capable of firing.

23. The automatic pistol of claim 21 wherein said slide includes a slide ejection port area defining a forward engaging surface and wherein said forward engaging surface engages said abutting surface of said barrel unit upon rearward movement thereof to move said barrel unit rearwardly.

24. An automatic pistol, which comprises:

a frame;

a barrel unit including a barrel chamber portion and a barrel element extending from said barrel chamber portion, said barrel element defining a longitudinal axis, said barrel unit defining an abutment surface oriented at an angle relative to said longitudinal axis; and a slide mounted on said frame and reciprocally longitudinally moveable relative to said frame between a forward position and a rearward position, said slide including a slide ejection port area defining a forward engaging surface, said slide initially freely rearwardly moveable relative to said barrel unit to an engaging position of said slide, said engaging position being rearwardly displaced from said forward position, wherein at said engaging position said forward engaging surface of said slide engages said abutment surface of said barrel unit thereby moving said barrel unit to an at least rearward position to permit loading of a cartridge into said barrel chamber portion.

* * * * *